US010337789B2

(12) United States Patent
Park

(10) Patent No.: US 10,337,789 B2
(45) Date of Patent: Jul. 2, 2019

(54) REFRIGERATOR WITH REMOVABLE WATER TANK

(71) Applicant: LG ELECTRONICS INC., Seoul (KR)

(72) Inventor: Jisu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 14/953,646

(22) Filed: Nov. 30, 2015

(65) Prior Publication Data

US 2016/0201979 A1 Jul. 14, 2016

(30) Foreign Application Priority Data

Jan. 9, 2015 (KR) ..... 10-2015-0003345

(51) Int. Cl.

| | |
|---|---|
| ***F25D 11/02*** | (2006.01) |
| ***F25D 23/12*** | (2006.01) |
| ***F25D 23/02*** | (2006.01) |

(52) U.S. Cl.

CPC ..... *F25D 23/126* (2013.01); *F25D 11/02* (2013.01); *F25D 23/025* (2013.01); *F25D 2323/021* (2013.01); *F25D 2323/122* (2013.01)

(58) Field of Classification Search

CPC .. F25D 23/126; F25D 2323/122; F25D 11/02; F25D 23/025; F25D 2323/021; F25C 2400/14

USPC ..... 62/389

See application file for complete search history.

(56) References Cited

U.S. PATENT DOCUMENTS

2009/0126392 A1* 5/2009 An ..... F25D 23/126 62/389

FOREIGN PATENT DOCUMENTS

| | | | |
|---|---|---|---|
| CN | 2459283 | 11/2001 | |
| CN | 1605822 | 4/2005 | |
| CN | 1321307 | 6/2007 | |
| CN | 103673479 | 3/2014 | |
| JP | H02-135463 | 11/1990 | |
| JP | H10-288437 | 10/1998 | |
| JP | 2004197965 | * 7/2004 | ..... F25C 1/24 |
| JP | 2010-197009 | 9/2010 | |
| JP | 2011-012835 | 1/2011 | |

(Continued)

OTHER PUBLICATIONS

Machine translation of JP10288437.*

(Continued)

*Primary Examiner* — Joseph F Trpisovsky

(74) *Attorney, Agent, or Firm* — Fish & Richardson P.C.

(57) ABSTRACT

A refrigerator is described. The refrigerator includes a cabinet that defines a storage compartment. The refrigerator further includes a door. The refrigerator further includes a water tank that is located at an inside of the door and that is configured to supply water. The water tank includes a storage unit that is configured to store water. The water tank further includes a valve that is configured to supply water stored in the storage unit. The water tank further includes a cover. The cover includes a cover support part that protrudes to a side of the storage unit and that is configured to be supported by an upper side of the storage unit. The cover further includes a gasket that comprises a protrusion that protrudes toward an inside wall of the storage unit at the side toward which the cover support part protrudes.

21 Claims, 5 Drawing Sheets

(56) References Cited

FOREIGN PATENT DOCUMENTS

| | | |
|---|---|---|
| KR | 10-2013-0006229 | 1/2013 |
| WO | 2005/036077 | 4/2005 |

OTHER PUBLICATIONS

Extended European Search Report issued in European Application No. 15198419.2 dated May 17, 2016, 8 pages.
Chinese Office Action in China Application No. 201510818958.6, dated Nov. 16, 2017, 11 pages (with English translation).

* cited by examiner

REFRIGERATOR WITH REMOVABLE WATER TANK

CROSS REFERENCE TO RELATED APPLICATION

This application claims the benefit of Korean Patent Application No. 10-2015-0003345, filed on Jan. 9, 2015 which is hereby incorporated by reference as if fully set forth herein.

FIELD

The present disclosure relates to a refrigerator, and more particularly to a refrigerator including a water tank located in a door of the refrigerator for storing water.

BACKGROUND

A refrigerator is an apparatus that supplies cool air generated by a refrigeration cycle into a storage compartment defined therein to store food at a low temperature for a long time.

In general, in order for a user to avoid the inconvenience of having to open a door every time the user wishes to drink a beverage stored in the storage compartment, a dispenser is provided in the front of the door, and a water tank is provided at the inside of the door, such that the user can drink a beverage stored in the water tank through the dispenser without opening the door.

Meanwhile, the water tank includes a storage unit for storing water and a cover for covering the storage unit. A gasket is provided between the upper side of the storage unit and the cover for preventing the leakage of water.

SUMMARY

An innovative aspect of the subject matter described in this specification may be implemented in a refrigerator that includes a cabinet that defines a storage compartment; a door that is configured to open and close the storage compartment; and a water tank that is located at an inside of the door and that is configured to supply water, the water tank includes a storage unit that is configured to store water; a valve that is configured to supply water stored in the storage unit; and a cover that is configured to open and close the storage unit, the cover including a cover support part that protrudes to a side of the storage unit and that is configured to be supported by an upper side of the storage unit; and a gasket that includes a protrusion that protrudes toward an inside wall of the storage unit at the side toward which the cover support part protrudes.

These and other implementations can each optionally include one or more of the following features. The protrusion includes contact parts that are configured to contact the inside wall of the storage compartment. The protrusion defines a recess that is located between the contact parts. The cover defines a hollow part. The gasket further includes a body that is located in the hollow part and that is connected to the protrusion. The cover includes a main cover; and an auxiliary cover that is configured to fasten to a lower part of the main cover, where the hollow part is defined by the main cover and the auxiliary cover. The main cover includes the cover support part. The main cover includes a hook hole. The auxiliary cover includes a hook that is configured to fasten to the hook hole. The main cover includes additional hook holes around a circumference of the main cover. The auxiliary cover includes additional hooks that are each configured to fasten to a respective additional hook hole. The hollow part includes a first rib and a second rib that each protrude downward from the main cover; and a third rib and a fourth rib that each protrude upward from the auxiliary cover. The second rib is longer than the first rib. The fourth rib is longer than the third rib. The cover support part is about perpendicular to the first rib and the second rib.

The first rib and the third rib align vertically and the second rib and the fourth rib are adjacent based on the hook being fastened to the hook hole. The hook hole is located at the second rib. The hook is located at the fourth rib. The first rib and the third rib define a through port. The protrusion is configured to protrude through the through port. The cover further includes an insertion part that is configured to be inserted into the storage unit. The insertion part further defines the hollow part. The insertion part defines a through port and a hollow part that communicates with the through port. The protrusion is configured to protrude through the through port. The gasket is made of a rubber material. The storage unit and an inner wall of the door define a storage space that is configured to hold water. The protrusion is located in part between the storage unit and the cover and in part between an inner wall of the door and the cover. The protrusion is configured to contact an inner wall of the door, is configured to create a water-tight seal between the inner wall of the door and the cover and between the storage unit and the cover, and is configured prevent rattling of the cover by dampening a force created during opening or closing of the door. The protrusion includes contact parts that are configured to create a water-tight seal between the storage compartment and the cover by contacting the inside wall of the storage compartment. The protrusion includes two contact parts.

An object of the subject matter described in this application is to provide a refrigerator including a water tank configured such that water is prevented from leaking from a space defined between a storage unit and a cover when a door is opened and closed.

Another object of the subject matter described in this application is to provide a refrigerator including a water tank configured such that a cover is prevented from being separated from a storage unit when a door is opened and closed.

DETAILED DESCRIPTION

Figure 1:
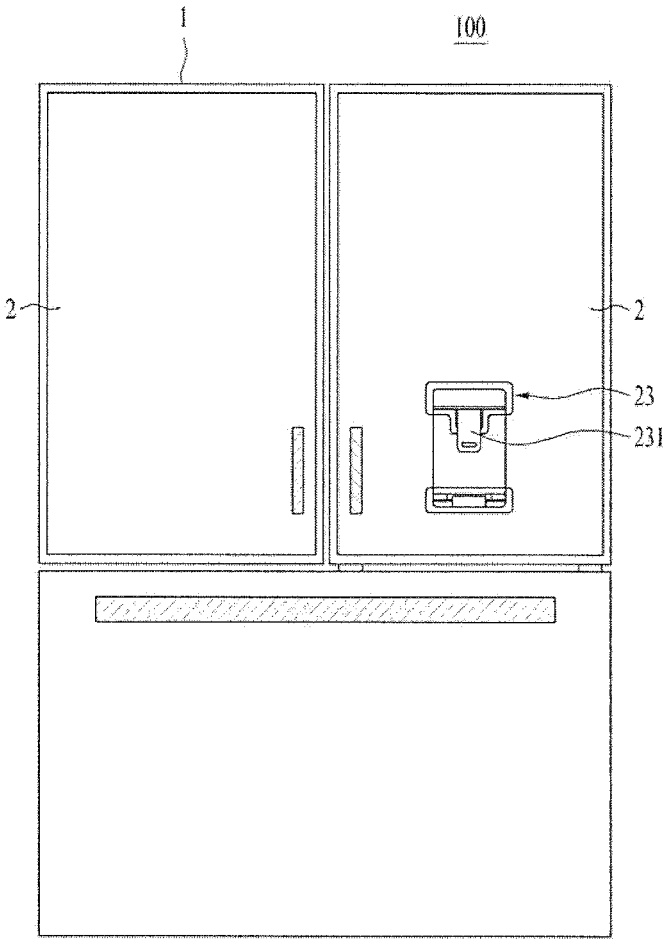
FIG. 1 is a front perspective view of an example refrigerator with the doors closed.

FIG. 1 illustrates an example refrigerator with the doors closed.

The refrigerator 100 includes a cabinet 1 having a storage compartment 11, a door 2 for opening and closing the storage compartment 11, a dispenser 23 provided in the door 2, and a water tank 25 for supplying water to the dispenser 23.

The dispenser 23 is provided in the front of the door 2. The dispenser 23 includes a water dispensing port 231 for providing water when a user pushes a water dispensing lever.

Figure 2:
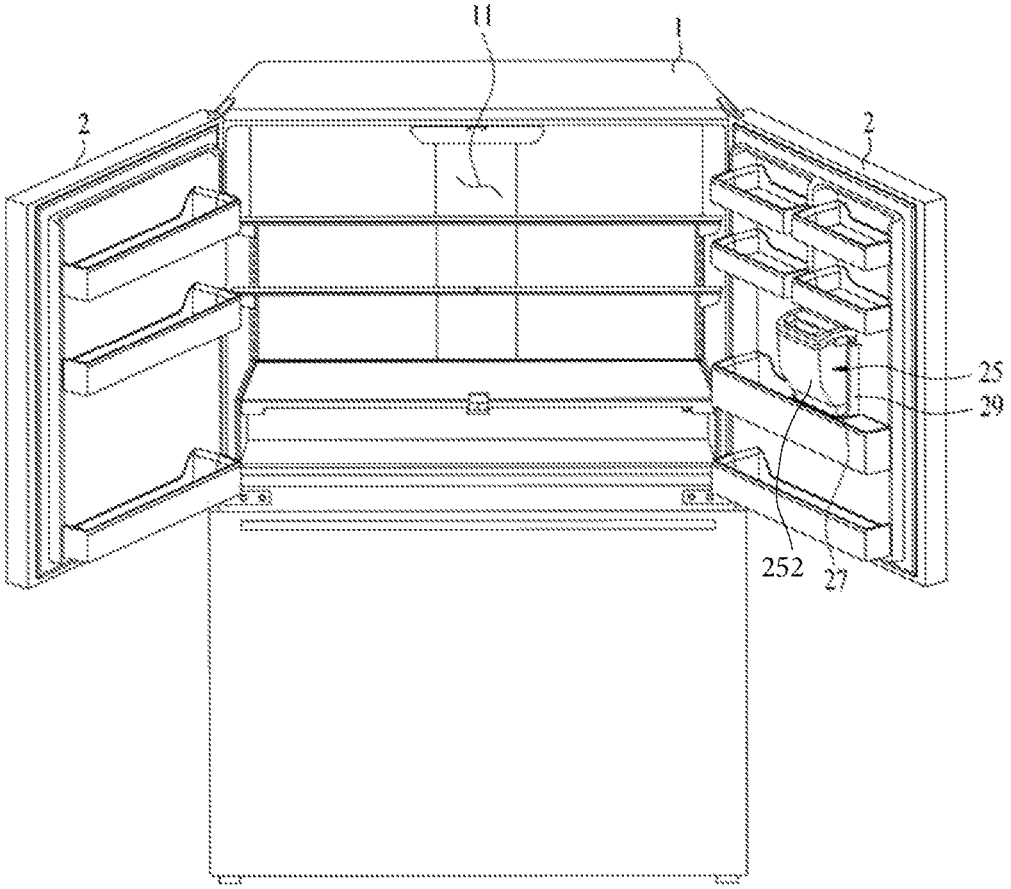
FIG. 2 is a front perspective view of an example refrigerator with the doors open.

FIG. 2 illustrates an example refrigerator with the doors open.

As shown in FIG. 2, the water tank 25 is provided at the rear of the door 2. Although not shown, the water tank 25 supplies water to the dispenser 23 through a drainage port provided at the rear of the door 2 so as to communicate with the water dispensing port 231.

Figure 3:
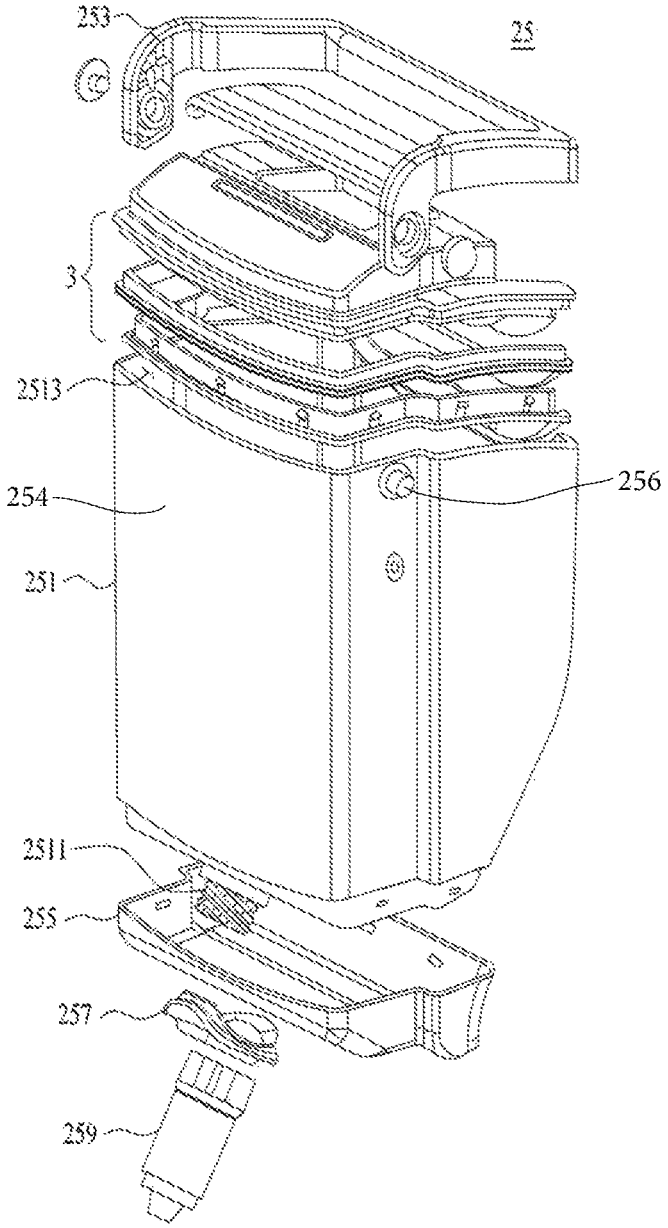
FIG. 3 is an exploded perspective view of an example water tank included in a refrigerator.

FIG. 3 illustrates an example water tank 25 included in a refrigerator.

The water tank 25 includes a storage unit 251 for storing water, a valve 259 for supplying the water stored in the storage unit 251 to a user through the dispenser 23; and a cover 3 for opening and closing the storage unit 251.

In addition, the water tank 25 may further include a handle 253 configured to be gripped by the user when the user moves while holding the water tank 25 and a decoration member 255 provided under the storage unit 251 for preventing damage to the storage unit 251.

One end of the valve 259 is fitted in a discharge port 2511 provided at the lower part of the storage unit 251, and the other end of the valve 259 is fitted in the drainage port.

When the user pushes the water dispensing lever of the dispenser 23, the valve 259 is opened. As a result, the water stored in the storage unit 251 is supplied to the water dispensing port 231 through the valve 259.

In addition, the water tank 25 may further include a sealing member 257 interposed between the valve 259 and the discharge port 2511 for preventing the leakage of cool air in the storage compartment 11 to the outside through the drainage port.

The diameter of the outer circumferential surface of the sealing member 257 is greater than that of the drainage port.

Meanwhile, the storage unit 251 has a space for storing water defined therein. The storage unit 251 has an opening 2513 formed at the upper side thereof.

Meanwhile, the cover 3 covers the upper side of the storage unit 251 in order to open and close the opening 2513. The cover 3 prevents the water stored in the storage unit 251 from overflowing.

Figure 4:
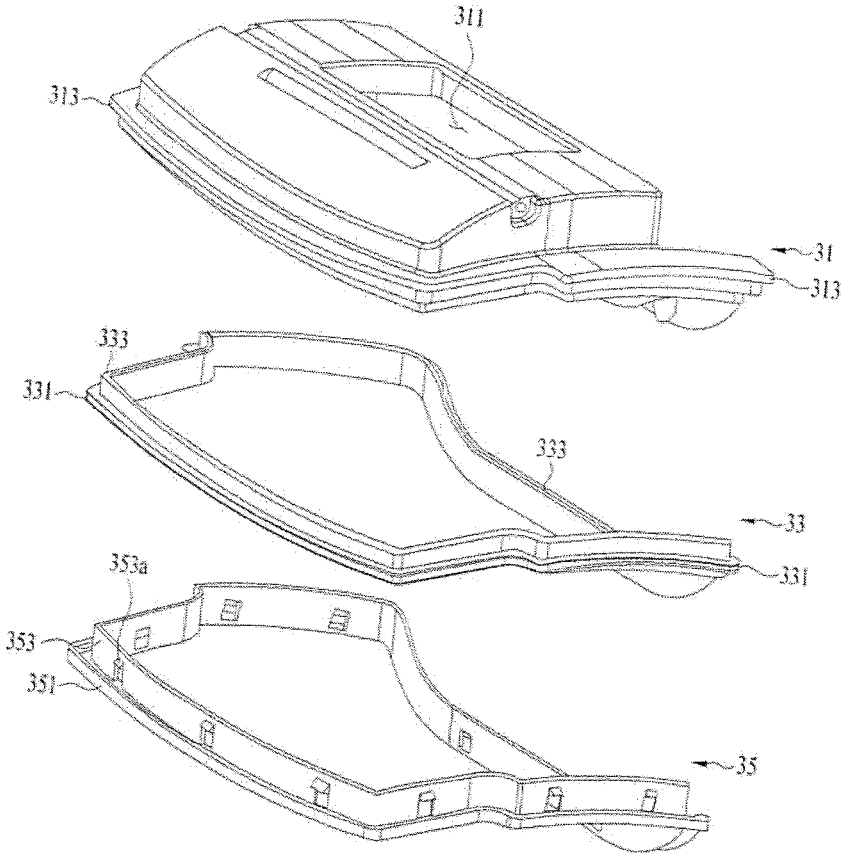
FIG. 4 is an exploded perspective view of an example cover included in a refrigerator.

The cover 3 will be described with reference to FIG. 4 illustrates an example cover 3 included in a refrigerator. The cover 3 may include a main cover 31, an auxiliary cover 35 fastened to the lower part of the main cover 31, and a gasket 33 interposed between the main cover 31 and the auxiliary cover 35.

The main cover 31 substantially opens and closes the opening 2513. The main cover 31 has a supply port 311, which is open so as to allow the user to supply water to the storage unit 251. The supply port 311 is opened and closed by a supply port cover hingedly connected to one side of the supply port 311.

The water tank 25 includes a shaft 256 that is coupled to the handle 253. The handle 253 is configured to rotate about the shaft 256. The shaft 256 is located closer to the back tank wall 254 than the front tank wall 252. When the water tank 25 is placed in the door 2 of the refrigerator 100, the back tank wall 254 is located closer to an inner wall of the door 2 than the front tank wall 252.

Figures 5A, 5B, 5C:
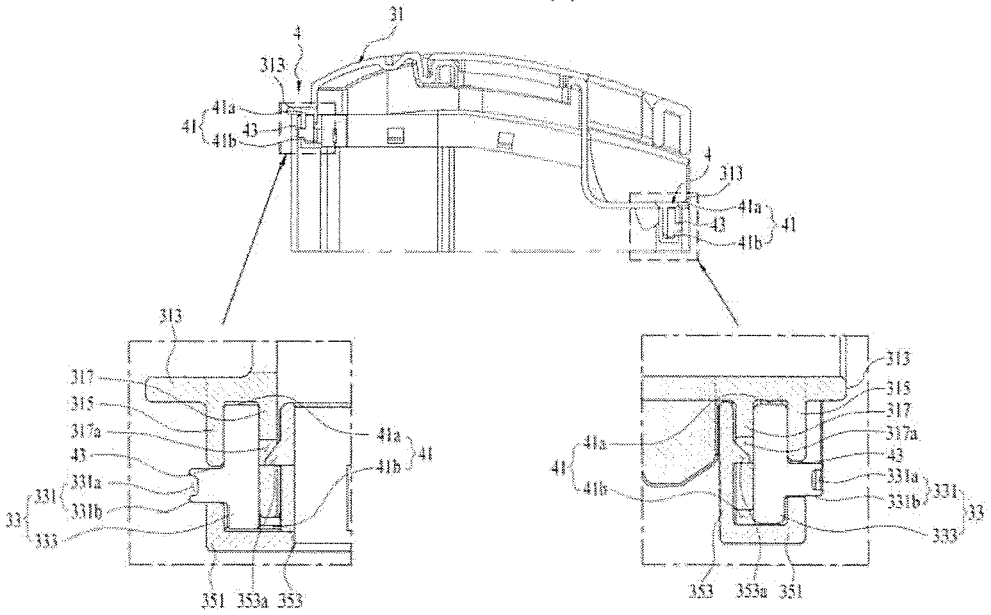
FIGS. 5(*a*)-5(*c*) are enlarged sectional views of an example water tank included in a refrigerator.

FIGS. 5(*a*)-5(*c*) illustrate an example water tank included in a refrigerator.

Referring to FIGS. 5(*a*), 5(*b*), and 5(*c*), the main cover 31 includes a cover support part 313 that protrudes horizontally. The cover support part 313 is supported at a sidewall of the storage unit 251 when the cover 3 covers the upper side of the storage unit 251.

The main cover 31 may further include a first rib 315 protruding downward and a second rib 317 protruding downward while being spaced apart from the first rib 315 by a predetermined distance. A first hollow part 41*a*, which is open downward, is provided between the first rib 315 and the second rib 317.

The auxiliary cover 35 is provided under the main cover 31. The auxiliary cover 35 may include a third rib 351 protruding upward and a fourth rib 353 protruding upward while being spaced apart from the third rib 351 by a predetermined distance. A second hollow part 41*b*, which is open upward, is provided between the third rib 351 and the fourth rib 353.

When the auxiliary cover 35 is fastened to the lower part of the main cover 31, therefore, the first hollow part 41*a* and the second hollow part 41*b* constitute a single hollow part 41.

Hereinafter, a structure in which the auxiliary cover 35 is fastened to the main cover 31 will be described.

The cover 3 may further include a hook 353*a* protruding from the fourth rib 353 and a hook hole 317*a* formed through the second rib 317 such that the hook 353*a* is inserted through the hook hole 317*a*. Alternatively, a hook recess may be provided in place of the hook hole 317*a* such that the hook 353*a* is inserted into the hook recess.

Consequently, the hook 353*a* may be inserted and fixed through the hook hole 317*a* in order to fasten the auxiliary cover 35 to the main cover 31.

Alternatively, the hook 353*a* may be provided at the second rib 317, and the hook hole 317*a* may be provided at the fourth rib 353.

Meanwhile, in a state in which the auxiliary cover 35 is fastened to the main cover 31, the first rib 315 and the third rib 351 may be spaced apart from each other by a predetermined distance. The first rib 315 and the third rib 351 constitute a through port 43. The through port 43 communicates with the hollow part 41.

Meanwhile, the gasket 33 may include a body 333 provided in the hollow part 41 and a protrusion 331 connected to the body 333 so as to protrude through the through port 43.

The body 333, provided in the hollow part 41, serves to support the protrusion 331.

Meanwhile, the protrusion 331 is brought into contact with the inner wall of the storage compartment 11 so as to prevent the leakage of the water stored in the storage compartment 11 to the outside. In addition, the protrusion 331 prevents the cover 3 from being separated from the storage unit 251 thanks to force with which the protrusion 331 pushes the inner wall of the storage compartment 11.

In other words, the protrusion 331 applies force to the inner wall of the storage compartment 11 to push the inner wall of the storage compartment 11. As a result, the protrusion 331 prevents water from leaking between the storage compartment 11 and the cover 3 and, prevents the cover 3 from being separated from the storage unit 251, due to the rattling of the door or splashing of the water when the door is opened or closed.

In addition, the protrusion 331 includes a recess 331*a* that is concave toward the body 333 and two contact parts 331*b* that are brought into contact with the inside wall of the storage compartment 11 in a state in which the recess 331*a* is interposed between the contact parts 331*b*.

When the cover 3 covers the opening 2513, therefore, the contact parts 331*b* press the inside wall of the storage compartment 11, and an air layer defined in the recess 331*a*, interposed between the contact parts 331*b*, prevents the water stored in the storage unit 251 from leaking to the outside.

In addition, the gasket 33 may be made of an elastic material that exhibits high elasticity. For example, the gasket 33 may be made of rubber.

In some implementations, the protrusion 331 may have a predetermined length such that the cover 3 is forcibly fitted in the opening 2513.

Hereinafter, the cover 3 included in the refrigerator 100 will be described in more detail with reference to FIG. 5(*a*).

The cover 3 includes an insertion part 4 configured to be inserted into the storage unit 251 and a gasket 33 protruding from the insertion part 4 for sealing a gap defined between the inside wall of the storage unit 251 and the insertion part 4.

In addition, the cover 3 further includes a cover support part 313 protruding from the upper part of the insertion part 4. The cover support part 313 supports the cover at the upper part of the storage unit 251.

The gasket 33 may be made of an elastic material that exhibits high elasticity. For example, the gasket 33 may be made of rubber.

In addition, the gasket 33 includes a recess 331*a* that is concave and contact parts 331*b* that are brought into contact with the inside wall of the storage compartment 11 in a state in which the recess 331*a* is interposed between the contact parts 331*b*. When the contact parts 331*b* are brought into contact with the inside wall of the storage compartment 11, therefore, air is trapped in a space defined between the inside wall of the storage compartment 11 and the recess 331*a*.

In some implementations, the contact parts 331*b* may be forcibly fitted into the opening 2513 when the insertion part 4 is inserted into the opening 2513.

As a result, the water stored in the storage unit 251 is prevented from leaking to the outside, and the cover 3 is prevented from being separated from the storage unit 251, thanks to the air trapped in the space defined between the inside wall of the storage compartment 11 and the recess 331*a*.

In addition, the insertion part 4 has a hollow part 41 defined therein, and the insertion part 4 is provided at the side thereof with a through port 43, through which the hollow part 41 communicates with the outside.

In addition, the gasket 33 includes a protrusion 331 protruding through the through port 43 and a body 333 provided in the hollow part 41, the body 333 being connected to the protrusion 331.

In some implementations, the recess 331*a* and the contact parts 331*b* are provided at the protrusion 331.

The body 333, provided in the hollow part 41, serves to support the protrusion 331.

As is apparent from the above description, the refrigerator includes a water tank configured such that water is prevented from leaking from a space defined between a storage unit and a cover when a door is opened and closed.

In addition, the refrigerator includes a water tank configured such that a cover is prevented from being separated from a storage unit when a door is opened and closed.

What is claimed is:

1. A refrigerator comprising:
- a cabinet that defines a storage compartment;
- a door that is configured to open and close the storage compartment; and
- a water tank that is detachably mounted on the door and that comprises:
  - a handle that is configured for a user to grasp;
  - a storage unit that is configured to store water, that defines an opening, that is rotatably coupled to the handle, and that comprises:
    - a first wall that faces an inner surface of the door based on the water tank being mounted on the door;
    - a second wall provided opposite to the first wall; and
    - a shaft coupled to the handle and located closer to the first wall than the second wall,
    - wherein the handle extends from the shaft toward the second wall;
  - a valve that is configured to selectively dispense water, that is mounted on lower portion of the storage unit, that is located below the shaft, and that is located closer to the first wall than the second wall; and
  - a cover that is detachably coupled to the storage unit and that is configured to cover the opening.

2. The refrigerator of claim 1, wherein the storage unit further comprises:
- side walls that are located between the first wall and the second wall; and
- stepped surfaces that protrude outside of the side walls;
- wherein the handle is coupled to a part of the storage unit other than the stepped surfaces and is configured to stop rotating based on contacting the stepped surfaces.

3. The refrigerator according to claim 2, comprising:
- a cover support part that protrudes to a side of the storage unit and that is configured to be supported by an upper side of the storage unit; and
- a gasket that comprises a protrusion that protrudes toward an inside wall of the storage unit at the side toward which the cover support part protrudes,
- wherein the protrusion comprises contact parts that are configured to contact the inside wall of the storage compartment,
- wherein the protrusion defines a recess that is located between the contact parts,
- wherein the cover defines a hollow part, and
- wherein the gasket further comprises a body that is located in the hollow part and that is connected to the protrusion.

4. The refrigerator according to claim 3, wherein the cover comprises:
- a main cover; and
- an auxiliary cover that is configured to fasten to a lower part of the main cover,
- wherein the hollow part is defined by the main cover and the auxiliary cover.

5. The refrigerator according to claim 4, wherein the main cover includes the cover support part.

6. The refrigerator according to claim 4, wherein:
- the main cover includes a hook hole, and
- the auxiliary cover includes a hook that is configured to fasten to the hook hole.

7. The refrigerator according to claim 6, wherein:
- the main cover includes additional hook holes around a circumference of the main cover, and
- the auxiliary cover includes additional hooks that are each configured to fasten to a respective additional hook hole.

8. The refrigerator according to claim 6, wherein the hollow part comprises:
- a first rib and a second rib that each protrude downward from the main cover; and a third rib and a fourth rib that each protrude upward from the auxiliary cover.

9. The refrigerator according to claim 8, wherein:

the second rib is longer than the first rib, and the fourth rib is longer than the third rib.

10. The refrigerator according to claim 8, wherein the cover support part is about perpendicular to the first rib and the second rib.

11. The refrigerator according to claim 8, wherein the first rib and the third rib align vertically and the second rib and the fourth rib are adjacent based on the hook being fastened to the hook hole.

12. The refrigerator according to claim 8, wherein:

the hook hole is located at the second rib, and the hook is located at the fourth rib.

13. The refrigerator according to claim 8, wherein:

the first rib and the third rib define a through port, and the protrusion is configured to protrude through the through port.

14. The refrigerator according to claim 3, wherein:

the cover further comprises an insertion part that is configured to be inserted into the storage unit, and the insertion part further defines the hollow part.

15. The refrigerator according to claim 14, wherein:

the insertion part defines a through port and a hollow part that communicates with the through port, and the protrusion is configured to protrude through the through port.

16. The refrigerator according to of claim 3, wherein the gasket is made of a rubber material.

17. The refrigerator according to claim 1, wherein the storage unit and an inner wall of the door define a storage space that is configured to hold water.

18. The refrigerator according to claim 3, wherein:

the protrusion is located in part between the storage unit and the cover and in part between an inner wall of the door and the cover, and the protrusion is configured to contact the inner wall of the door, is configured to create a water-tight seal between the inner wall of the door and the cover and between the storage unit and the cover, and is configured prevent rattling of the cover by dampening a force created during opening or closing of the door.

19. The refrigerator according to claim 3, wherein the protrusion comprises contact parts that are configured to create a water-tight seal between the storage compartment and the cover by contacting the inside wall of the storage compartment.

20. The refrigerator according to claim 19, wherein the protrusion comprises two contact parts.

21. A refrigerator comprising:

a cabinet that defines a storage compartment;

a door that is configured to open and close the storage compartment; and a water tank that is located at an inside of the door and that is configured to supply water, the water tank comprising:

a storage unit that is configured to store water;

a valve that is configured to supply water stored in the storage unit; and a cover that is configured to open and close the storage unit and that defines a hollow part, the cover comprising:

a cover support part that protrudes to a side of the storage unit and that is configured to be supported by an upper side of the storage unit; and a gasket comprising:

a protrusion (i) that protrudes toward an inside wall of the storage unit at the side toward which the cover support part protrudes, (ii) that includes contact parts that are configured to contact the inside wall of the storage compartment, and (iii) that defines a recess that is located between the contact parts; and a body that is located in the hollow part and that is connected to the protrusion.

* * * * *